US009349225B2

(12) United States Patent
Wanami et al.

(10) Patent No.: US 9,349,225 B2
(45) Date of Patent: May 24, 2016

(54) ACCIDENT REPORTING SYSTEM FOR VEHICLES

(71) Applicant: DENSO CORPORATION, Kariya, Aichi-pref. (JP)

(72) Inventors: Shingo Wanami, Kariya (JP); Shigenori Kobayashi, Hazu-gun (JP)

(73) Assignee: DENSO CORPORATION, Kariya, Aichi-Pref. (JP)

( * ) Notice: Subject to any disclaimer, the term of this patent is extended or adjusted under 35 U.S.C. 154(b) by 0 days.

(21) Appl. No.: 14/306,558

(22) Filed: Jun. 17, 2014

(65) Prior Publication Data

US 2014/0375446 A1 Dec. 25, 2014

(30) Foreign Application Priority Data

Jun. 20, 2013 (JP) ..... 2013-129105

(51) Int. Cl.

| | |
|---|---|
| ***G08B 21/18*** | (2006.01) |
| ***G07C 5/00*** | (2006.01) |
| ***G07C 5/08*** | (2006.01) |
| ***G08G 1/00*** | (2006.01) |
| *G08B 25/01* | (2006.01) |

(52) U.S. Cl.

CPC ..... *G07C 5/008* (2013.01); *G07C 5/0891* (2013.01); *G08G 1/205* (2013.01); *G08B 25/016* (2013.01)

(58) Field of Classification Search

CPC .... G07C 5/008; G07C 5/0891; G08B 25/016; G08B 25/018; B60R 25/10; B60R 25/00; B60R 1/00; G08G 1/205

USPC ..... 340/436

See application file for complete search history.

(56) References Cited

U.S. PATENT DOCUMENTS

| | | | | |
|---|---|---|---|---|
| 2002/0115423 | A1* | 8/2002 | Hatae et al. | 455/404 |
| 2007/0067079 | A1* | 3/2007 | Kosugi | 701/35 |
| 2007/0219685 | A1* | 9/2007 | Plante | 701/35 |
| 2008/0088482 | A1 | 4/2008 | Okada et al. | |
| 2010/0194887 | A1* | 8/2010 | Ono et al. | 348/148 |

FOREIGN PATENT DOCUMENTS

| | | |
|---|---|---|
| JP | 2002-293271 | 10/2002 |
| JP | 2007-293536 | 11/2007 |

(Continued)

OTHER PUBLICATIONS

Office Action mailed Apr. 21, 2015 in the corresponding JP application No. 2013-129105.

*Primary Examiner* — Hai Phan
*Assistant Examiner* — Sisay Yacob
(74) *Attorney, Agent, or Firm* — Harness, Dickey & Pierce, P.L.C.

(57) ABSTRACT

An accident report system for a vehicle includes an accident detection section to detect an accident; an information collection section to collect information; and an information report section to report the collected information to an external agency when the accident is detected. The information collection section differentiates the collected information before and after the detection of the accident such that (i) an accident cause data is collected before the detection of the accident to confirm an exterior outside of the vehicle and (ii) an accident damage data is collected after the detection of the accident to confirm an interior inside of the vehicle. The collection and report of the accident cause data and accident damage data permits the external agency to recognize states of the vehicle or states of an occupant of the vehicle before and after the detection of the accident.

13 Claims, 8 Drawing Sheets

(56) References Cited

FOREIGN PATENT DOCUMENTS

| | | | | |
|---|---|---|---|---|
| JP | 2008-118482 | 5/2008 | | |
| JP | 2008-123501 | 5/2008 | | |
| JP | 2010-114588 | 5/2010 | | |
| JP | 2011-205372 | 10/2011 | | |
| KR | 20070104100 | A | * | 10/2007 |

* cited by examiner

ACCIDENT REPORTING SYSTEM FOR VEHICLES

CROSS REFERENCE TO RELATED APPLICATION

The present application is based on Japanese Patent Application No. 2013-129105 filed on Jun. 20, 2013, the disclosure of which is incorporated herein by reference.

TECHNICAL FIELD

The present disclosure relates an accident report system that detects an occurrence of an accident and reports accident information to an external agency.

BACKGROUND ART

Patent Literature 1: JP 2010-114588 A

Patent Literature 1 discloses a portable mobile phone attached to a vehicle with a function of an accident report following detection of an accident. The mobile phone includes the following. A camera captures an image of an area forward of the vehicle. A memory records data including the captured image only during a fixed duration. A communicator conducts an accident report to transmit the recorded data together with a vehicle position and vehicle speed to a predetermined information collection center via a base station of mobile-phone line when an acceleration sensor detects an acceleration greater than a predetermined level.

The technology in Patent Literature 1 does not teach a situation of an occupant after the accident since the camera only captures an image of an area forward of the vehicle even after the accident. This makes it difficult for the information collection center having received the accident report to determine whether to need an emergency lifesaving activity.

SUMMARY

It is an object of the present disclosure to provide an accident report system to teach a situation of an occupant after an accident is detected.

To achieve the above object, according to an example of the present disclosure, an accident report system for a vehicle is provided to include an accident detection section, an information collection section, and an information report section. The accident detection section detects an occurrence of an accident about the vehicle. The information collection section collects information. The information report section reports the information collected by the information collection section to an external agency when the occurrence of the accident is detected by the accident detection section. The information collection section provides, as the information collected, (i) an accident cause data that is collected before the occurrence of the accident is detected to confirm a cause of the accident and (ii) an accident damage data that is collected after the occurrence of the accident is detected to confirm a damage of the accident. Further, the accident damage data is differentiated from the accident cause data.

Under such a configuration, the collection and report of the accident cause data and accident damage data can indicate a situation of an occupant of the vehicle, further permitting a determination as to whether to need an emergency lifesaving activity.

BRIEF DESCRIPTION OF THE DRAWINGS

The above and other objects, features, and advantages of the present disclosure will become more apparent from the following detailed description made with reference to the accompanying drawings. In the drawings.

DETAILED DESCRIPTION

Embodiments of the present disclosure will be explained with reference to drawings.

[First Embodiment]

Figure 1:
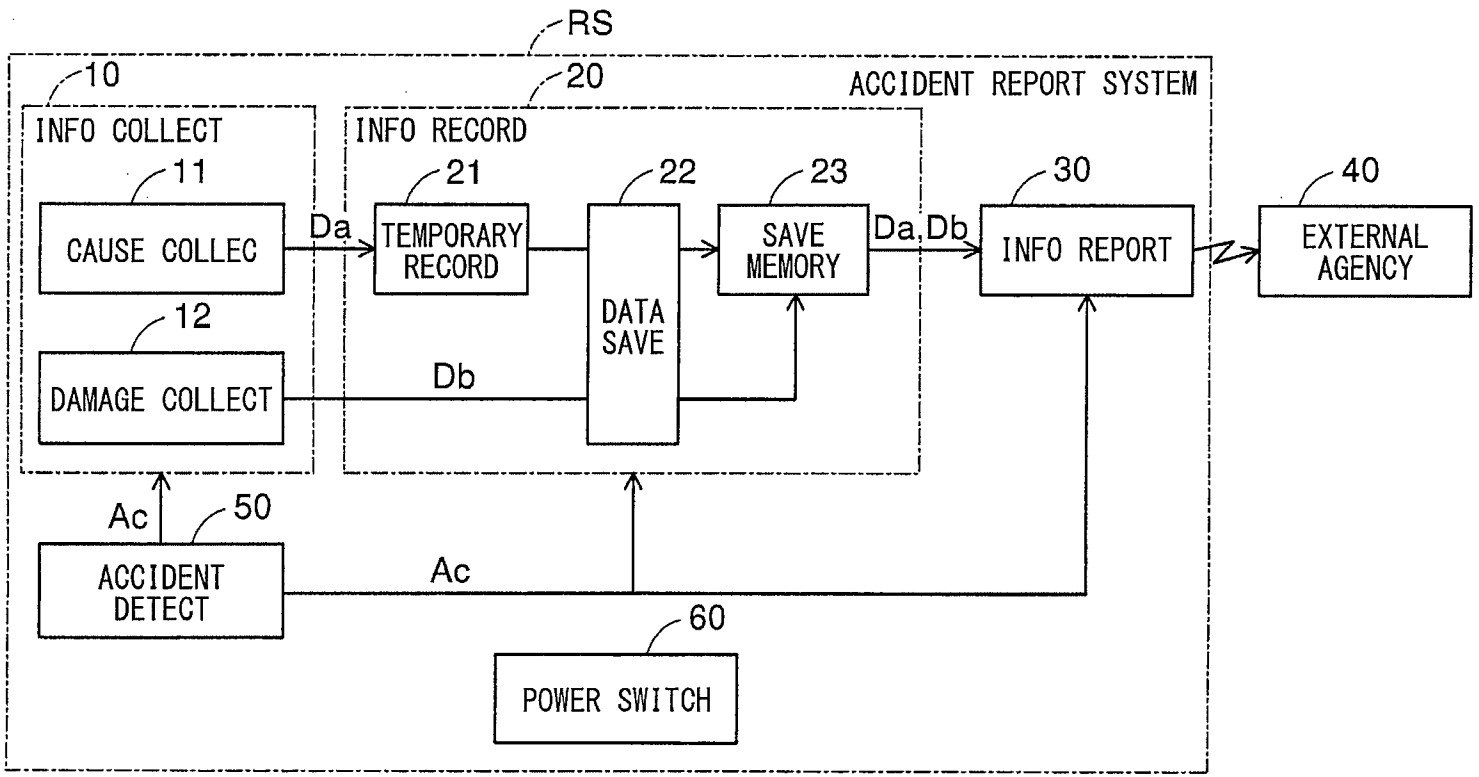
FIG. 1 is a schematic diagram illustrating an example of a configuration of an accident report system in a vehicle according to a first embodiment of the present disclosure.

An accident report system RS in a vehicle 100 according to a first embodiment of the present disclosure is explained with reference to FIGS. 1 to 8. With reference to FIG. 1, the accident report system RS includes an information collection section 10, an information record section 20, an information report section 30, an accident detection section 50, and a power switch section 60. The above respective sections may be provided as a hardware component, a software component achieved by a CPU executing programs, or a combination of the hardware component and the software component. The hardware component and the software component along with the CPU may be contained in an ECU (Electronic control unit) that will be explained later in detail.

The accident detection section 50 detects an accident or an occurrence of the accident based on a change in a detection value detected by a sensor in the vehicle 100 to output a detection signal Ac. The sensor may be any one that can detect an accident. For example, the sensor may include pressure sensors 101, 104, and an acceleration sensor 102 in FIG. 2. In addition, the sensor may include a speed sensor; an angular velocity sensor; a steering-wheel angle sensor; a shock sensor; a field sensor containing a radar sensor and motion sensor; and an airbag sensor for inflating air bags. The first embodiment may provide only one sensor or a combination of more than one sensor, as needed. The above sensor may be shared as a sensor used by the information collection section 10, as mentioned later. In short, any sensor may be used as long as the sensor can detect an accident related to the vehicle 100 regardless of whether the vehicle 100 collides with an object.

The information collection section 10 includes a cause data collection portion 11 and a damage data collection portion 12 in order to collect data about an accident of the vehicle 100. The cause data collection portion 11 operates before receiving a detection signal Ac. The damage data collection portion 12 operates after receiving the detection signal Ac.

The cause data collection portion 11 collects data from a sensor provided in the vehicle 100 and records (i.e., stores) the data in a temporary memory 21 for temporary recording as an accident cause data Da. The above sensor may be any one if being able to obtain the data which permits the confirmation of a cause of the accident. For example, the sensor may include the pressure sensors 101, 104, the acceleration sensor 102, and the camera 105 in FIG. 2, and further include a speed sensor, an angular velocity sensor, a steering-wheel angle sensor, a gyroscope, and a beacon, which are unshown. The first embodiment may provide only one sensor or a combination of more than one sensor, as needed. Other than a sensor, a satellite positioning system may be provided, similarly. Such a satellite positioning system may include a navigation system, a GPS (Global Positioning System) apparatus, and a quasi-zenith satellite system (QZSS).

The damage data collection portion 12 collects data from a sensor provided in the vehicle 100 and records (i.e., stores) the data in a save memory 23 via a data save portion 22 as an accident damage data Db. The above sensor may be any one if being able to obtain the data which permits the confirmation of a damage of the accident. For example, the sensor may include the camera 105 and the microphone 107 in FIG. 2, and further include a sitting sensor, an electromagnetic wave sensor (including an infrared sensor), a night vision apparatus (including thermography apparatus), a sonic wave sensor (including a sonar, an ultrasonic sensor, and a sound sensitive sensor), and a gyroscope, which are unshown. The first embodiment may provide only one sensor or a combination of more than one sensor, as needed. Other than a sensor, the above satellite positioning system may be provided, similarly.

The information record section 20 includes a temporary memory 21 for temporarily recording data, a data save portion 22, and a save memory 23 for saving data. The information record section 20 controls recording data in storage media (i.e., in the temporary memory 21 and the save memory 23); the data are (i) the accident cause data Da that is transmitted from the cause data collection portion 11 and (ii) the accident damage data Db that is transmitted from the damage data collection portion 12.

The temporary memory 21 may adopt storage media that can record data temporarily; the storage media may include a volatile memory or a nonvolatile memory. The volatile memory may include a DRAM or a SRAM. The nonvolatile memory may include a flash memory (including a memory card, a magnetoresistive RAM (MRAM), a resistance RAM (ReRAM), a ferroelectric RAM (FeRAM), a nonvolatile RAM (NVRAM), or a hard disk. The save memory 23 may include storage media such as the above nonvolatile memory that can hold data even without power supply from the power source such as the main battery 103, the backup memory 109 in FIG. 2. Further, each of the temporary memory 21 and the save memory 23 may use storage media included in the ECU (Electronic Control Unit) 108 in FIG. 2.

The data save portion 22 saves the data before and after a detection of an accident based on a detection signal Ac transmitted from the accident detection section 50. To be specific, the accident cause data Da recorded in the temporary memory 21 is read out and recorded or saved in the data save portion 22; the accident damage data Db transmitted from the damage data collection portion 12 is recorded or saved in the data save portion 22. The vehicle 100 may include a plurality of save memories 23. An accident may damage a save memory 23 to disable data read-out. To prepare for such a trouble, more than one save memory 23 may be used to record data.

The information report section 30 reports the accident cause data Da and the accident damage data Db which are recorded in the save memory 23 to an external agency 40. The information report section 30 only need communicate with the external agency 40 and need not specifically limit a communication technique (wired or wireless) or a communication path (base station or relay station). In the first embodiment, the information report section 30 is configured by a combination of the ECU 108 and the communicator 110 in FIG. 2.

The external agency 40 only need be an agency or organization about handling of an accident or emergency lifesaving activity. For example, the external agency 40 may include a police station, an emergency service (fire station), an information collection center (traffic accident center, disaster emergency information center), or an insurance company.

The power switch section 60 performs switchover to switch a first power source of a plurality of power sources to a second power source of the plurality of power sources when the first power source does not supply an electric power. Not supplying an electric power corresponds to not only the case where any electric power is not supplied, but also to the case where the supplied electric power falls outside a tolerance power range. In the first embodiment, the plurality of power sources include a main battery 103 and a backup battery 109 (auxiliary battery) in FIG. 2. To be specific, the power switch section 60 switches to the main battery 103 for supplying the electric power in a usual case while switching to the backup battery 109 for supplying the electric power in an unusual case where the electric power is not supplied from the main battery 103 due to any cause such as an accident. The power switch section 60 conducts a switch control to supply a necessary electric power for actuating the damage data collection portion 12, the data save portion 22, the save memory 23, and the information report section 30, at least for ensuring the data collection or the report, in particular, after the detection of an accident. The power source may include a lithium cell, a lead storage battery, a solar cell, or a fuel cell.

Figure 2:
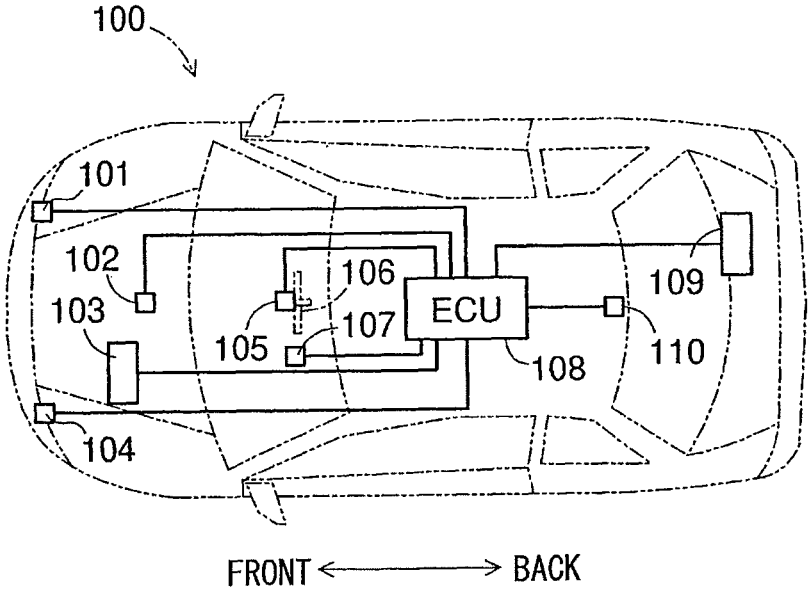
FIG. 2 is a schematic plan view illustrating an example of a configuration of a vehicle according to a first embodiment of the present disclosure.

The above accident report system RS, the battery, etc., may be disposed in anywhere in the vehicle 100 on the condition that the elements provide the respective functions minimally. With reference to FIG. 2, in the front side of the vehicle 100, the pressure sensors 101, 104, the acceleration sensor 102, and the main battery 103 are mounted; in the back side (e.g., inside of a trunk), the backup battery 109 is mounted. In the roof of the vehicle 100, a communicator 110 is provided.

The pressure sensors 101, 104 are provided in the front bumper. The acceleration sensor 102 and the main battery 103 are provided in the hood (bonnet). The camera 105 is provided in a rearview mirror 106 (see FIG. 3). The microphone 107 is provided in the same position as that of or in proximity of the camera 105. Alternatively, the camera 105 may be provided in a pillar, a windshield, or a dashboard; the microphone 107 may be provided in a steering wheel, a console, an instrument panel, or a dashboard. Further, the communicator 110 may be provided in a fender, a pillar, or a trunk.

The configuration example of FIG. 2 includes only one ECU 108 for simple examination; the configuration may include a plurality of ECUs for distributed processing as needed. The configuration may include the following: a sensor ECU to manage one or more than one sensor; a drive ECU to control drive components such as an engine, a motor; a battery ECU including the power switch section 60 to manage one or more than one battery; and/or an occupant protection ECU to protect an occupant 113, for instance, by inflating airbags (see FIG. 8). When a plurality of ECUs are provided, it is desirable that a predetermined ECU (e.g., ECU 108) may function as managing all the ECUs comprehensively.

Figure 3:
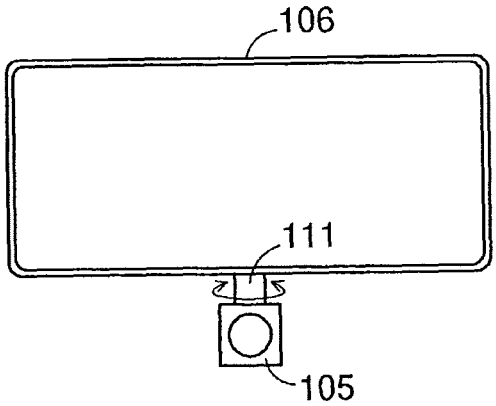
FIG. 3 is a schematic diagram illustrating a first example of a configuration of a camera according to the first embodiment.

With reference to FIG. 3, the camera 105 in the first embodiment is attached to the rearview mirror 106 at a lower end portion of the rearview mirror 106 via a rotation mechanism 111. The camera 105 of the present embodiment only need capture images but need not specify the kind of lenses such as a single focus lens, a zoom lens, a fish-eye lens. The vehicle 100 is apt to receive vibration during running so that the camera 105 is desirably to have a blurring correction mechanism regardless of an optical type or electronic type. In order to widen an image capture range, the camera 105 is desirably to have a greater field angle. In order to make images or videos clearer, the camera 105 is desirably to have a larger depth of field such as pan-focus and/or an auto-focusing function such as hybrid auto-focusing function. In order to permit an image capture in a dark circumference outside of the vehicle 100 such as a nighttime or a tunnel, an interior light may be turned on compulsorily at a detection of an accident; or a night vision apparatus such as an infrared camera, thermography apparatus may be provided separately. The rotation mechanism 111 only need rotate based on an instruction signal from the ECU 108. The camera 105 is provided to change postures following the rotation control so as to capture (i) an image of a forward area or forward scenery of the vehicle 100 (that is, an exterior of the vehicle 100) (see FIG. 7) or (ii) an image of a vehicle compartment 112 of the vehicle 100 (that is, an interior of the vehicle 100) (see FIG. 8).

The following explains a record/report process executed by the accident report system RS with reference to FIGS. 4 to 8. It is noted that S12, S13, S14, and S15 may be executed in parallel processing. In addition, the vehicle 100 may be equipped with an optical sensor and a night vision apparatus. In such a case, the daytime or nighttime is determined based on a signal outputted from the optical sensor, so the camera 105 is switched to the night vision apparatus when the nighttime is determined.

It is further noted that a flowchart of the process in the present application includes sections (also referred to as steps), which are represented, for instance, as S10. Further, each section can be divided into several sections while several sections can be combined into a single section. Furthermore, each of thus configured sections can be referred to as a module, device, or means and achieved not only (i) as a software section in combination with a hardware unit (e.g., computer), but also (ii) as a hardware section (e.g., integrated circuit, hard-wired logic circuit), including or not including a function of a related apparatus. Further, the hardware section may be inside of a microcomputer.

Figure 5:
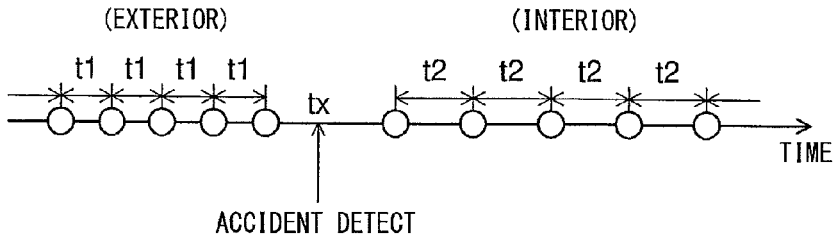
FIG. 5 is a schematic diagram illustrating an example of change in sampling time intervals before and after a detection of an accident according to the first embodiment.
Figure 6:
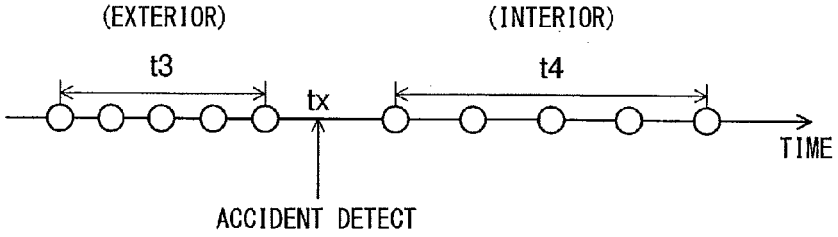
FIG. 6 is a schematic diagram illustrating an example of change in data collecting time durations before and after a detection of an accident according to the first embodiment.
Figure 7:
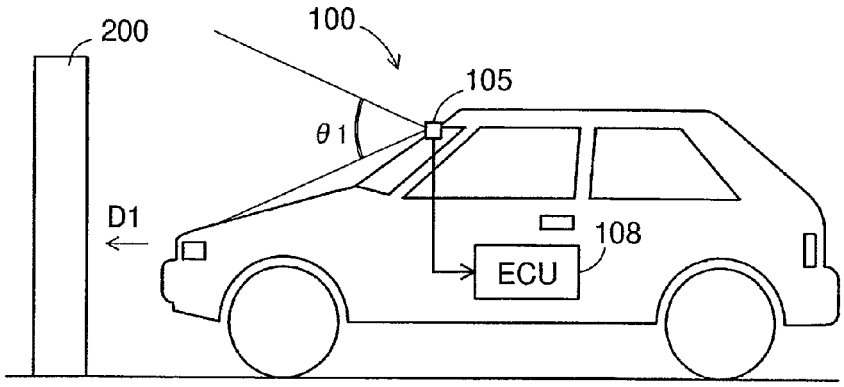
FIG. 7 is a schematic diagram illustrating an example of collecting accident cause data before a detection of an accident according to the first embodiment.

At S10, an accident cause data Da is recorded in the temporary memory 21 (while any accident is not detected) before a detection signal Ac is transmitted from the accident detection section 50 (S11: YES). The accident cause data Da includes at least one of the following: the pressure data based on the pressure sensors 101, 104; the acceleration data based on the acceleration sensor 102; the image capture data based on the camera 105; the angular velocity data based on the angular velocity sensor; the speed data based on the speed sensor; the steering-wheel angle data based on the steering-wheel angle sensor; the posture data based on the gyroscope; the position data based on the beacon; and the positioning data measured by the satellite positioning system. It is noted that the camera 105 is disposed to take a posture to capture an image of an exterior area outside of the vehicle 100 as illustrated in FIG. 7; the image capture data corresponds to an image capture data of an exterior (i.e., a forward area) of the vehicle 100. The temporary memory 21 has a storage capacity (i.e., the capacity of the recording region) that is physically limited, so that a newer data may be recorded to overwrite an older data. The accident cause data Da may be recorded with sampling time intervals t1 by a required number of times of samplings as illustrated in FIG. 5, or recorded within (during) a collecting time duration t3 by a required number of times as illustrated in FIG. 6. The sampling time interval t1 and the collecting time duration t3 may be designated to be fixed or variable as needed.

When the detection signal Ac is transmitted from the accident detection section 50 (S11: YES), the power source is secured in order to prepare for a loss of data. That is, when the electric power is supplied from the main battery 103 (S12: YES), the electric power continues to be supplied from the main battery 103. The processing then directly advances to S14. In contrast, when the electric power is not supplied from the main battery 103 (S12: NO), the main battery 103 is switched to the backup battery 109 for receiving the supply of electric power (S13) from the backup battery 109. The processing then advances to S14.

At S14, with reception of a detection of an accident, the accident cause data Da that have been recorded in the temporary memory 21 are saved by the data save portion 22. To be specific, the accident cause data Da are read out from the temporary memory 21 and then recorded in the save memory 23. In parallel with the above saving processing, a warn is desirably outputted to another vehicle other than the vehicle 100 within an allowable limit of the residual quantity of the electric power of the battery; the warn may be provided to turn on or blink lights such as a head lamp, hazard flasher, backlight.

Figure 8:
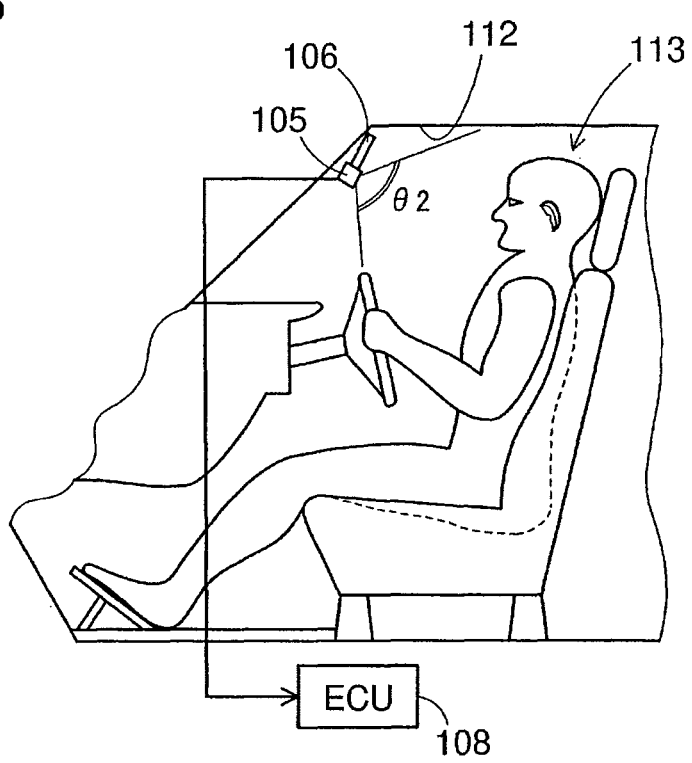
FIG. 8 is a schematic diagram illustrating an example of collecting accident damage data after a detection of an accident according to the first embodiment.

At S15, the target of data to be collected is changed or differentiated from up to this time point. The target of data may be changed in various manners. In the first embodiment, the accident cause data Da corresponds to the information on an exterior or exterior area outside of the vehicle 100; the accident damage data Db corresponds to the information on an interior or interior area (vehicle compartment 112) inside of the vehicle 100. For example, the accident damage data Db includes at least one of the following: the image capture data based on the camera 105; the sound data based on the microphone 107; the seating data based on the sitting sensor; the moving state data based on the electromagnetic wave sensor; the dark vision data based on night vision apparatus; the sound wave data based on the sonic wave sensor; the posture data based on the gyroscope; and the positioning data measured by the satellite positioning system. It is noted that the camera 105 is disposed to take a posture to capture an image of an interior area inside of the vehicle 100 as illustrated in FIG. 8, the image capture data corresponds to an image capture data of an interior (i.e., a vehicle compartment 112) of the vehicle 100. In order to certainly capture an image of the situation of the vehicle compartment 112 with the usual camera 105 within an allowable limit of the residual quantity of the electric power of the battery, the interior lights may be turned on in a proactive manner.

At S16 after changing the target of data at S15, the data save portion 22 records the accident damage data Db in the save memory 23. Recording the accident damage data Db is continued until a collection end condition is fulfilled (S17: YES). The accident damage data Db may be recorded with sampling time intervals t2 by a required number of times of samplings as illustrated in FIG. 5, or recorded within (during) a collecting time duration t4 by a required number of times as illustrated in FIG. 6. The sampling time interval t2 and the collecting time duration t4 may designated as needed. The collection end condition may be also designated as needed. For example, it may be designated to be a predetermined time period (for example, one minute or one hour) from the time point tx of detecting an accident, or to be a data volume recorded in the save memory 23. The storage capacity of the save memory 23 is physically limited, so that the recording may be continued until a non-recording region disappears. However, in order to record the history or change process from the detection of the accident, it is desirable to prevent a newer data from overwriting an older data.

When the collection end condition is fulfilled (S17: YES), the accident cause data Da and the accident damage data Db which have been recorded in the save memory 23 are transmitted or reported to the external agency 40 (S18). The process is then returned. To be specific, the data are transmitted to the at least one external agency 40 from the ECU 108 via the communicator 110 in FIG. 2.

The above first embodiment provides advantageous effects as follows.

(1) The accident report system RS includes the information collection section 10 that collects accident cause data Da before an occurrence of an accident that is detected by the accident detection section 50, and accident damage data Db after the occurrence of the accident; the accident damage data Db is collected to be differentiated from the accident cause data Da (see FIG. 1-FIG. 8). Such a configuration differentiates the data after the detection of the accident from the data before the detection of the accident; namely, the accident cause data Da about an exterior of the vehicle 100 is collected before the detection of the accident whereas the accident cause data Da about an interior or vehicle compartment 112 inside of the vehicle 100 is collected after the detection of the accident. In such a configuration, the collection and report of the accident cause data Da and the accident damage data Db can indicate or teach the situation of the vehicle 100 and the occupant 113 before and after the occurrence of the accident or the detection of the accident. This can teach what a kind of measure or what a kind of emergency lifesaving activity is necessary in advance. In addition, the data before and after the detection of the accident are reported; this can save the data of the accident site.

(2) The information collection section 10 differentiates the accident damage data Db from the accident cause data Da in respect of a target of data collected (see FIG. 5 and FIG. 6). For instance, the accident cause data Da targets an exterior area outside of the vehicle 100, whereas the accident damage data Db targets an interior area or vehicle compartment 112 of the vehicle 100. Differentiating the targets of data before and after the detection of the accident can teach the situation of the occupant 113 of the vehicle 100, further permitting a determination as to whether to need an emergency lifesaving activity.

Figure 4:
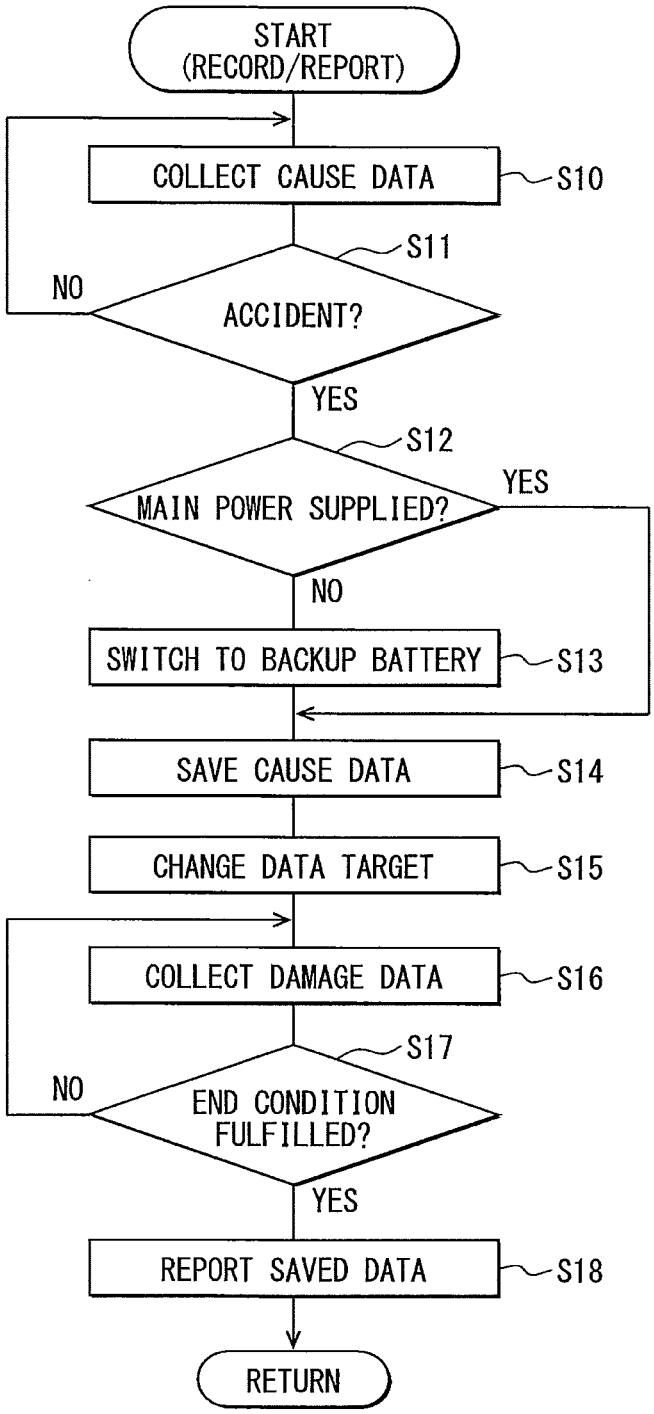
FIG. 4 is a flowchart diagram illustrating an example of a record/report process according to the first embodiment.

(3) The data save portion 22 is provided to save (i) the accident cause data Da and (ii) the accident damage data Db, after the occurrence of the accident is detected (see FIG. 1 and FIG. 4 (S14, S16)). Such a configuration can save the accident cause data Da and the accident damage data Db even if the electric power supply from the power source (the main battery 103 and backup battery 109) is shut down. Therefore, the data before and after the detection of the accident can be certainly maintainable.

(4) The information collection section 10 designates (i) first sampling time intervals t1 with which the accident cause data Da are sampled or collected and (ii) second sampling time intervals t2 with which the accident damage data Db are sampled or collected; the first sampling time interval t1 is designated to be smaller than the second sampling time interval t2 (see FIG. 5). An occurrence cause of the accident may be investigated from a comparatively rapid change in a running state before the detection of the accident. The above configuration may narrow down the focus to the important data of the accident by designating the sampling time interval t1 before the detection of the accident to be smaller (or more frequent) than the sampling time interval t2 after the detection of the accident. This further can report the occurrence state of the accident to the external agency 40 efficiently and accurately while suppressing the data volume of the report to the external agency 40.

(5) The information collection section 10 designates (i) a first collecting time duration t3 during which the accident cause data Da are collected and (ii) a second collecting time duration t4 during which the accident damage data Db are collected; the first collecting time duration t3 is designated to be smaller than the second collecting time duration t4 (see FIG. 6). The damage situation after the detection of the accident may be taught by a change in a situation of the vehicle compartment 112 for a relatively long time duration after the detection of the accident such as a movement of the occupant 113 after the accident. The above configuration may narrow down the focus to the important data of the accident by designating the collecting time duration t3 before the detection of the accident to be smaller (or shorter) than the collecting time duration t4 after the detection of the accident. This further can report the state taking place after the detection of the accident to the external agency 40 efficiently and accurately while suppressing the data volume of the report to the external agency 40.

(6) The accident cause data Da contain an image data that captures an image of an exterior outside of the vehicle 100 with the camera 105 (see FIG. 1-FIG. 7). In the example of FIG. 7, the vehicle 100 advances along the arrow D1 before the detection of the accident so that an object 200 is image-captured. The above configuration enables the external agency 40 receiving the accident cause data Da to understand the movements of vehicles including the vehicle 100 and a situation outside of the vehicle 100 before the detection of the accident, facilitating an investigation of a cause of the accident. In addition, the privacy of the occupant 113 may be protected in a usual case.

(7) The accident damage data Db contain an image data that captures an image of an interior or vehicle compartment 112 inside of the vehicle 100 with the camera 105 (see FIGS. 1 to 6, 8). In the example of FIG. 8, the vehicle compartment 112 after the detection of the accident is image-captured. The above configuration enables the external agency 40 receiving the accident damage data Db to understand the situation of the vehicle 100 and the occupant 113 after the detection of the accident. This can teach what a kind of measure or what a kind of emergency lifesaving activity is necessary in advance.

(8) The information collection section 10 includes the camera 105, which takes (i) a first posture to capture an image of an exterior of the vehicle 100 before the occurrence of the accident is detected and (ii) a second posture to capture an image of an interior or the vehicle compartment 112 of the vehicle 100 after the occurrence of the accident is detected (see FIG. 1, FIG. 5, FIG. 7, and FIG. 8). Such a configuration enables the rotation mechanism 111 to control the posture of the single camera 105 to capture an image of an exterior outside of the vehicle 100 and an image of an interior or the vehicle compartment 112 inside of the vehicle 100.

(9) The information collection section 10 collects a sound recording data recorded by the microphone 107 to be contained in one of or both of the accident cause data Da and the accident damage data Db (see FIG. 2). In other words, the information collection section 10 collects the information that contains a sound data recorded with the microphone 107. For example, the sound recording data before the detection of the accident may correspond to a brake sound or a klaxon horn sound; the sound recording data after the detection of the accident may correspond to a voice uttered by the occupant 113. Such a configuration permits an analysis of the sound recording data before and after the detection of the accident, thereby indicating the situation before and after the accident. For example, the sound recording data after the accident may correspond to a sound produced in the vehicle 100, a voice of the occupant 113 such as "the leg (arm) is pinched; moving is impossible" or "smelling smoky", which are uttered by either the occupant 113 or a person who witnesses the accident and conducts a rescue. In particular, such sounds are very useful to understand a situation that cannot be understood only with an image or video. Reporting such sounds including voice enables the external agency 40 to understand in advance what a kind of measure or what a kind of emergency lifesaving activity is necessary after the accident.

(10) The power switch section 60 is provided to switch a plurality of power sources (main battery 103 and backup battery 109) so as to continue the supply of electric power to the information collection section 10 and the information report section 30 when one of the power sources stops the supply of electric power (FIGS. 1 and 2). Such a configuration continuously supplies the electric power from either the main battery 103 or the backup battery 109 to the elements, thereby conducting certainly the recording of the accident cause data Da and the accident damage data Db and the report to the external agency 40.

[Second Embodiment]

Figure 9:
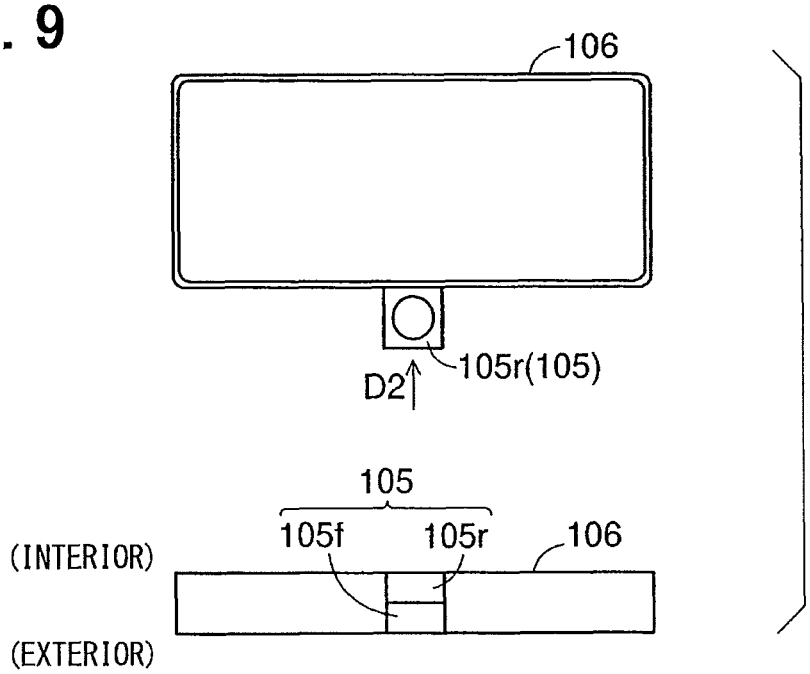
FIG. 9 is a schematic diagram illustrating a second example of a configuration of a camera according to a second embodiment of the present disclosure.

The following explains a second embodiment of the present disclosure with reference to FIG. 9. The upper portion of FIG. 9 illustrates an example of a configuration seen from the same direction as that in FIG. 3; the lower portion of FIG. 9 illustrates an example of the configuration seen from the arrow D2 in the upper portion.

The camera 105 indicated in FIG. 9 replaces the camera 105 in FIG. 3 and includes a first camera unit 105*f* and a second camera unit 105*r*. The first camera unit 105*f* captures an image of an exterior area outside of the vehicle 100; the second camera unit 105*r* captures an image of an interior or vehicle compartment 112 inside of the vehicle 100. The first camera unit 105*f* and the second camera unit 105*r* may be provided as separate independent camera units, or as a single modularized package.

The first camera unit 105*f* may provide a field angle θ1 indicated in FIG. 7; the second camera unit 105*r* may provide a field angle θ2 indicated in FIG. 8. The field angle θ1 and the field angle θ2 may be designated to be an identical angle (θ1=θ2), or to be different angles (θ1≠θ2). In order to capture an image of the vehicle compartment 112 broadly, it is desirable to secure the field angle θ2 to be greater than the field angle θ1 (θ1<θ2).

At S10 in FIG. 4, the image capture data captured by the first camera unit 105*f* is recorded in the temporary memory 21; at S16, the image capture data captured by the second camera unit 105*r* is recorded or saved in the save memory 23. Thus, the first camera unit 105*f* and the second camera unit 105*r* of the camera 105 can capture an image of an exterior area outside of the vehicle 100 and an image of an interior area or the vehicle compartment 112, respectively; this does not need the rotation mechanism 111.

The second embodiment has a configuration identical to that of the first embodiment except for the camera 105 in FIG. 9. Thus, the second embodiment can provide the same advantageous effects (1) to (7), (9) to (10) except for (8) of the first embodiment. The second embodiment further provides advantageous effects as follows.

(11) The camera 105 of the information collection section 10 includes the first camera unit 105*f* to capture an image of an exterior of the vehicle 100 before the detection of the accident, and the second camera unit 105*r* to capture an image of an interior or the vehicle compartment 112 of the vehicle 100 (see FIG. 9). Thus, the first camera unit 105*f* and the second camera unit 105*r* can capture an image of an exterior area outside of the vehicle 100 and an image of an interior area or the vehicle compartment 112, respectively; this does not need the rotation mechanism 111.

(12) The first camera unit 105*f* and the second camera unit 105*r* are provided as a single modularized package. The package containing both the first camera unit 105*f* and the second camera unit 105*r* can be treated as a single camera 105. This configuration permits an output function or the like of image capture data to be shared by two camera units 105*f* and 105*r* and reduces the number of components.

[Other Embodiments]

Figure 10:
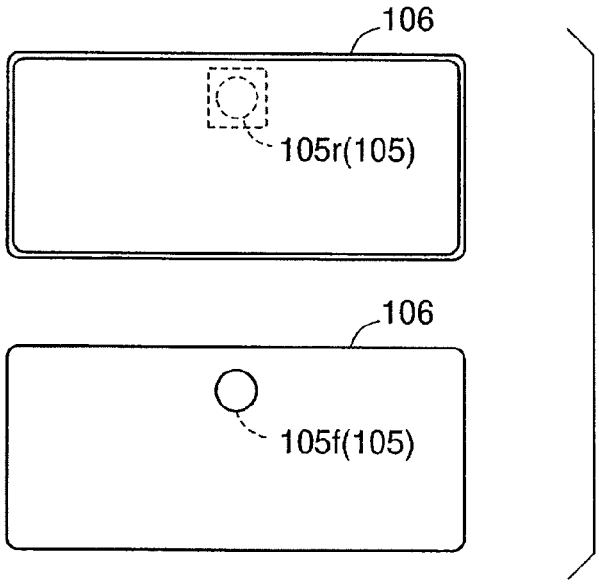
FIG. 10 is a schematic diagram illustrating a third example of a configuration of a camera according to another embodiment of the present disclosure.

The first embodiment provides the camera 105 to be attached to an end portion of the rearview mirror 106 via the rotation mechanism 111 (see FIG. 3). The second embodiment provides the camera 105 containing the first camera unit 105*f* and the second camera unit 105*r* to be attached to an end portion of the rearview mirror 106 (see FIG. 9). Alternatively, the camera 105 may be provided to be embedded in the rearview mirror 106 as indicated in FIG. 10. The upper portion of FIG. 10 illustrates an example of a configuration seen from the mirror face (facing a driver) of the rearview mirror 106; the lower portion of FIG. 10 illustrates an example of the configuration seen from the front side of the vehicle 100. The mirror face may be provided to include a polarizing glass or one-way mirror that is disposed at a portion corresponding to the camera 105 or at a portion corresponding to the whole of the mirror face. The mirror face may include a hole having a diameter of the lens of the camera 105. The camera 105 may be provided to be disposed at another position in the vehicle compartment 112 other than rearview mirror 106. For example, it may be disposed at the windshield, glass window, pillar, sun visor, steering wheel, console, or dashboard. As long as an exterior and an interior of the vehicle 100 can be image captured before and after the detection of an accident regardless of where the camera 105 is disposed, the same advantageous effects can be provided.

In addition, the camera 105 is disposed in a front side of the vehicle compartment 112, as illustrated in FIG. 2. There is no need to be limited thereto. The camera 105 may be disposed in a rear side of the vehicle compartment 112 or in a left or right side thereof. The accident may originate from the vehicle 100 itself or from another vehicle different from the vehicle 100. For example, an accident may occur due to a different vehicle following the vehicle 100 or running parallel at the left or right side of the vehicle 100. Even in such an accident, a cause can be easily investigated with an image capture data obtained by the camera 105.

Figure 11:
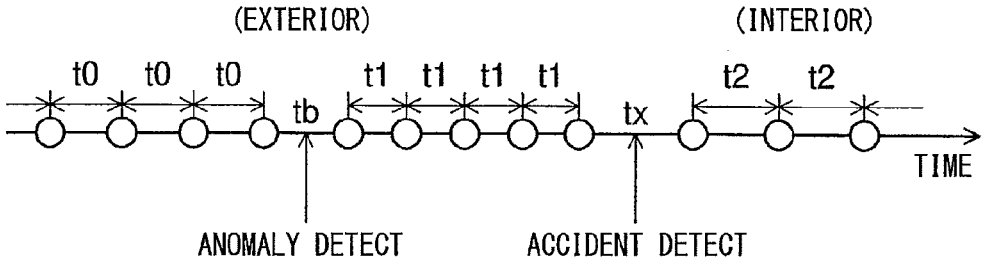
FIG. 11 is a schematic diagram illustrating an example of change in sampling time intervals before and after a detection of an accident according to another embodiment of the present disclosure.

In the first and second embodiments, the accident detection section 50 differentiates the sampling time intervals t1 and t2 (FIG. 5) or the collecting time durations t3 and t4 (FIG. 6) before and after the detection of an accident. In addition, the configuration may differentiate the sampling time intervals t0 and t1 from each other before and after the time tb of detecting a behavior anomaly of the vehicle 100 as indicated in FIG. 11. The behavior anomaly includes sudden braking, sudden acceleration, excessive speed, unusual steering wheel manipulation (sharp turn, abrupt switchback), unusual steering wheel manipulation (abrupt steering, the cutback, etc.), or drowsy driving, exhibiting an anomaly in the behavior of the vehicle 100. The behavior anomaly may be determined based on the variation in the detection signal outputted from the acceleration sensor 102, speed sensor, or angle sensor, for instance. A normal driving manipulation takes place until the behavior anomaly detection time point tb. Before the time point tb, the accident cause data Da may be recorded with the sampling time intervals t0 (t0≥t1) in the temporary memory 21. After the time point tb, the accident cause data Da may be recorded with the sampling time intervals t1 (t0≥t1) in the temporary memory 21. A similar modification may be applied to the collecting time duration in FIG. 6. Anyway, reporting the accident cause data Da recorded before and after the anomaly behavior to the external agency 40 may facilitate the investigation of the cause.

In the first and second embodiments, the accident cause data Da and accident damage data Db are transmitted to the external agency 40 when the collection end condition is fulfilled (S17 in FIG. 4). Another configuration may be alternatively provided to include (i) an inquiry to an occupant 113, (ii) a selection of an external agency 40 to be reported as a report addressee, or the like. To be specific, S18 in FIG. 4 is replaced with a report process illustrated in FIG. 12. In other words, the report process in FIG. 12 may be conducted as a subroutine of the record/report process in FIG. 4.

Figure 12:
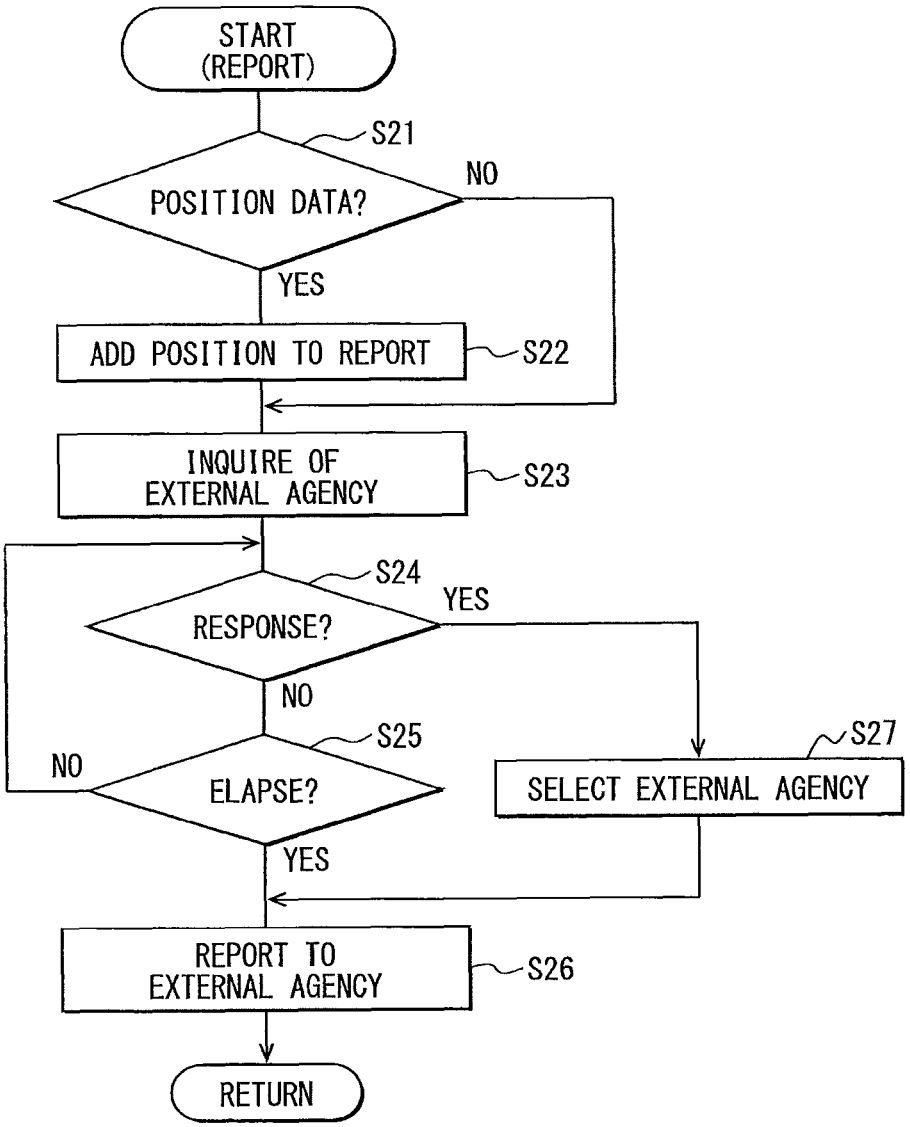
FIG. 12 is a flowchart diagram illustrating an example of a report process according to another embodiment of the present disclosure.

In FIG. 12, when a position data measured by the satellite positioning system is acquirable (S21: YES), the measured position data is acquired and then included in a report data (S22). The measured position data may be a combination of a latitude, a longitude, and an altitude; an address (street, city, prefecture or the like); or a map indicating a present position. In short, any information may be used which permits the accident detection section 50 to specify the present position or site at which an accident is detected.

Figure 13:
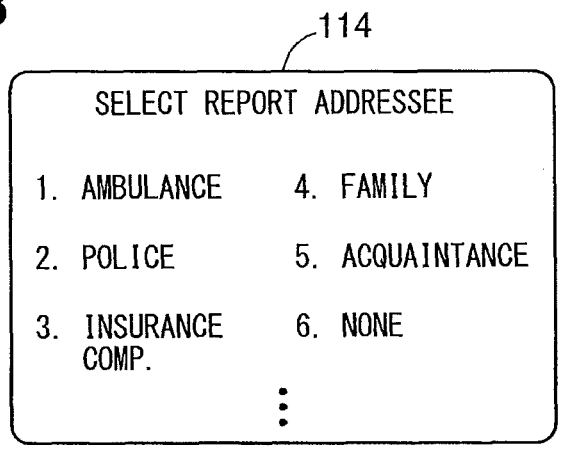
FIG. 13 is a schematic diagram illustrating an example of an inquiry window.

Next, an inquiry is conducted about the report to the external agency 40 (S23). For example, FIG. 13 illustrates an example of an inquiry or inquiry window displayed in a display unit 114 in the vehicle 100; further, a sound of an inquiry may be outputted from a speaker in the vehicle 100. An inquiry may be conducted with only a display or only a sound, or further be conducted with another measure. The display unit 114 may be disposed inside of the vehicle 100 (in particular, in the vehicle compartment 112); namely, it may be assembled into a dashboard, console, or instrument panel or another display may be commonly used.

Such an inquiry may be conducted in considering the case where the occupant 113 does not need any report or the case where the occupant 113 intends to select an external agency 40 from a plurality of candidates. Thus, an inquiry is conducted to the occupant 113 (S23) and the subsequent measure may be switched based on whether to receive a response to the inquiry within a predetermined reception time period or until the predetermined reception time period elapses (S24, S25). Further, an inquiry to the occupant 113 may be conducted not only to confirm the state or intention of the occupant 113, but also to prevent an erroneous report in not the case of an accident (for example, due to a mis-operation or mis-detection of a sensor). The above reception time period may be designated as needed, for instance, ten seconds or one minute. Within the reception time period, the inquiry window in FIG. 13 may be displayed. When a response is received within the reception time period (S24: YES), it is supposed that the occupant 113 is conscious. An external agency 40 is thus selected (S27). In this case, a report is transmitted to the external agency 40 according to the selection (S26). The process is then returned. At S27, the selection may be conducted with a button or switch in the vehicle 100. The display unit 114 may be equipped with a touch panel. Further, a navigation system in the vehicle 100 may be used. It is noted that the inquiry may be conducted to a person other than the occupant 113 such as a witness, rescue person.

When any response is not received within the reception time period (S24: NO, S25: YES), there is a high possibility that the occupant 113 is unconscious. When there is no change in the data obtained by the sitting sensor, electromagnetic wave sensor, sonic wave sensor, or gyroscope, there is also a high possibility that the occupant 113 is unconscious. In this case, the report is transmitted to an external agency 40 (in particular, to an emergency (ambulance) service or police station) compulsorily or automatically (S26). The process is then returned. The external agencies 40 may be changed depending on the acceleration value detected by the acceleration sensor 102.

Figure 14:
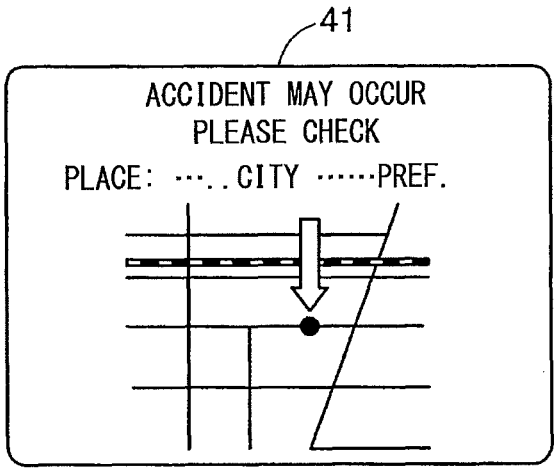
FIG. 14 is a schematic diagram illustrating an example of a display window displaying external agencies.

The external agency 40 receiving the report may be provided with a display unit 41 to display a position data or a map indicating a present position of the vehicle 100, as illustrated in FIG. 14. In other words, the report transmitted from the accident report system RS to the external agency 40 may desirably contain a data indicating a place or a map indicating a present position of the vehicle 100. Such positional information along with the accident cause data Da and accident damage data Db facilitates the dispatch of an authorized personnel to the site of an accident and the necessary measure or emergency lifesaving activity.

Figure 15:
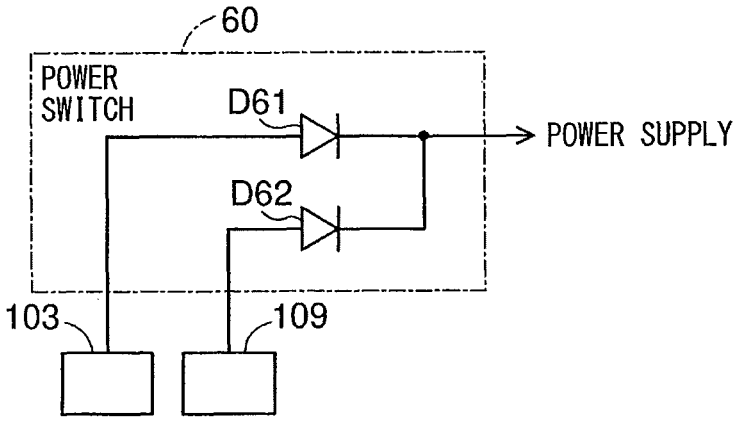
FIG. 15 is a schematic diagram illustrating an example of a power switch section.

In the first and second embodiments, the batteries are switched based on whether an electric power is supplied from the main battery 103 (see S12, S13 in FIG. 4). Another configuration indicated in FIG. 15 may be provided alternatively. The power switch section 60 indicated in FIG. 15 includes diodes D61, D62. The anode of the diode D61 is connected to the main battery 103; the anode of the diode D62 is connected to the backup battery 109. The cathodes of the diodes D61 and D62 are connected to each other to supply an electric power to a recipient of the power supply such as the accident report system RS or ECU 108. The electric power (i.e., voltage) of either the main battery 103 or the backup battery 109, whichever provides a higher electric power. This configuration can eliminate S12 and S13 in FIG. 4, thereby simplifying the configuration of supplying the electric power. Therefore, the same operational advantageous effects as the first and second embodiments can be provided.

In the first and second embodiments, the power source adopts the main battery 103 or the backup battery 109 (see FIG. 2). Alternatively, a solar cell or a capacitor may be adopted. In short, the electric power only needs to save the accident cause data Da and the accident damage data Db and the report of them to the external agency 40. Therefore, the same operational advantageous effects as the first and second embodiments can be provided.

In the first and second embodiments, after detecting an accident by the accident detection section 50, the accident damage data Db about the vehicle compartment 112 is saved and reported to the external agency 40 (see FIG. 4-FIG. 6, and FIG. 8). Alternatively, the accident damage data Db may further contain a data of an exterior outside of the vehicle 100 (that is, which is equivalent to the accident cause data Da). Capturing an image of an exterior outside of the vehicle 100 with the camera 105 can make clear a person (i.e., a victim, witness) related to the accident.

In the first and second embodiments, the information report section 30 reports the accident cause data Da and the accident damage data Db which are recorded in the save memory 23 to an external agency 40 (see S18 in FIG. 4, and S26 in FIG. 12). Further, the accident damage data Db which is not yet recorded in the save memory 23 may be transmitted to the external agency 40. That is, even after the collection end condition is fulfilled at S17 in FIG. 4 or the conditions at S24 and S25 are fulfilled, the accident damage data Db may be collected and reported to the external agency 40 regardless of whether to record them in the save memory 23. In such a configuration, a real-time change of the situation in the vehicle compartment 112 (or an exterior of the vehicle 100) may be reported to the external agency 40. The external agency 40 can understand the change in real time to perform a measure according to the change, or an emergency lifesaving activity.

Further, the information in the report may contain information on the vehicle 100 such as a manufacture name, vehicle name, vehicle number, painting color, or the like. Such contained information permits an authorized personnel of the external agency 40 to easily specify the vehicle 100.

The following is noted. That is, the vehicle need not be limited to have a specified number of wheels. The accident only need be limited to relate with a vehicle. The accident need not be limited to a traffic accident from a travel or traffic of a vehicle. The accident may include an accident of a vehicle from a natural disaster such as an earthquake, flood damage, landslide, uplift, cave-in; the accident may further include an accident which do not result in a collision to an object or obstacle, such as a slip, roll. The external agency may include any agency or organization, which receives a report of an occurrence of an accident, such as a police station, an emergency service (fire station), an information collection center (traffic accident center, disaster emergency information center), or an insurance company. The camera may include any image capture apparatus which captures an image (static picture) or video (moving picture); the camera may include a camera or night-vision apparatus that can capture an image even in a nighttime, such as an infrared camera, thermography apparatus. To save data, any apparatus or process may be used which can save or hold the data even while the electric power supply from an electric power source is stopped or interrupted. The exterior of a vehicle includes any area other than a vehicle compartment of the vehicle or an exterior area outside of the vehicle without being limited to any specific direction or side such as forward, rearward, sideward.

While the present disclosure has been described with reference to preferred embodiments thereof, it is to be understood that the disclosure is not limited to the preferred embodiments and constructions. The present disclosure is intended to cover various modification and equivalent arrangements. In addition, while the various combinations and configurations, which are preferred, other combinations and configurations, including more, less or only a single element, are also within the spirit and scope of the present disclosure.

What is claimed is:

1. An accident-report system for a vehicle, comprising:

an accident detection section to detect an occurrence of an accident about the vehicle;

an information collection section to collect information; and an information report section to report the information collected by the information collection section to an external agency when the occurrence of the accident is detected by the accident detection section, wherein:

the information collection section provides, as the information collected, (i) an accident cause data that is collected before the occurrence of the accident is detected to confirm a cause of the accident and (ii) an accident damage data that is collected after the occurrence of the accident is detected to confirm a damage of the accident, the accident damage data being differentiated from the accident cause data; and the information collection section designates first sampling time intervals with which the accident cause data are sampled and second sampling time intervals with which the accident damage data are sampled, the first sampling time interval being designated to be smaller than the second sampling time interval.

2. The accident report system according to claim 1, wherein the information collection section differentiates the accident damage data from the accident cause data in respect of a target of data collected.

3. The accident report system according to claim 1, further comprising:

a data save portion to save, after the occurrence of the accident is detected, the accident cause data and the accident damage data.

4. The accident report system according to claim 1, wherein the information collection section designates a first collecting time duration during which the accident cause data are collected and a second collecting time duration during which the accident damage data are collected, the first collecting time duration being designated to be smaller than the second collecting time duration.

5. The accident report system according to claim 1, wherein the accident cause data contains an image capture data that captures an image of an exterior of the vehicle.

6. The accident report system according to claim 1, wherein:

the accident damage data contains an image capture data that captures an image of an interior of the vehicle.

7. The accident report system according to claim 1, wherein the information collection section includes a camera, which takes (i) a first posture to capture an image of an exterior of the vehicle before the occurrence of the accident is detected and (ii) a second posture to capture an image of an interior of the vehicle after the occurrence of the accident is detected.

8. The accident report system according to claim 1, wherein the information collection section collects the information that contains a sound data recorded with a microphone.

9. The accident report system according to claim 1, further comprising:

a plurality of power sources including a first power source and a second power source; and a power switch section to perform switchover to switch the first power source to the second power source when the first power source does not supply an electric power, wherein the information collection section and the information report section operate with an electric power supply due to the switchover performed by the power switch section.

10. The accident report system according to claim 1, wherein the information collection section includes a camera that contains (i) a first camera unit to capture an image of an exterior of the vehicle before the occurrence of the accident is detected and (ii) a second camera unit to capture an image of an interior of the vehicle after the occurrence of the accident is detected.

11. The accident report system according to claim 10, wherein the camera containing the first camera unit and the second camera unit is provided as a modularized package.

12. The accident report system according to claim 1, further comprising:

an anomaly detection section to detect, in the vehicle, an occurrence of a behavior anomaly not yet reaching the accident, by determining a threshold-exceding variation on a detection signal outputted from a sensor unit at least including one of an acceleration sensor, a speed sensor, or an angle sensor, wherein:

the information collection section provides, as the accident cause data to confirm the cause of the accident, (i) a prior-anomaly data that is collected before the occurrence of the behavior anomaly is detected and before the occurrence of the accident is detected and (ii) a post-anomaly data that is collected after the occurrence of the behavior anomaly is detected and before the occurrence of the accident is detected; and the information collection section designates, as the first sampling time intervals, post-anomaly sampling time intervals from a time when the behavior anomaly is detected to a time when the occurrence of the accident is detected, and further designates prior-anomaly sampling time intervals until the time when the occurrence of the behavior anomaly is detected, the prior-anomaly sampling time interval being designated to be greater than the post-anomaly sampling time interval being the first sampling time interval.

13. The accident report system according to claim 1, wherein the first sampling time interval is before a collision and the second sampling time interval is after the collision.

* * * * *